US007756714B2

(12) United States Patent
Iser et al.

(10) Patent No.: US 7,756,714 B2
(45) Date of Patent: Jul. 13, 2010

(54) SYSTEM AND METHOD FOR EXTENDING SPECTRAL BANDWIDTH OF AN AUDIO SIGNAL

(75) Inventors: Bernd Iser, Ulm (DE); Gerhard Schmidt, Ulm (DE)

(73) Assignee: Nuance Communications, Inc., Burlington, MA (US)

( * ) Notice: Subject to any disclaimer, the term of this patent is extended or adjusted under 35 U.S.C. 154(b) by 822 days.

(21) Appl. No.: 11/701,184

(22) Filed: Jan. 31, 2007

(65) Prior Publication Data

US 2008/0059155 A1 Mar. 6, 2008

(30) Foreign Application Priority Data

Jan. 31, 2006 (EP) ..... 06001984

(51) Int. Cl.
*G10L 19/14* (2006.01)

(52) U.S. Cl. ..... 704/500

(58) Field of Classification Search ..... 704/500
See application file for complete search history.

(56) References Cited

U.S. PATENT DOCUMENTS 7,630,881 B2 * 12/2009 Iser et al. ..... 704/203
7,693,714 B2 * 4/2010 Iser et al. ..... 704/243
2003/0044024 A1 3/2003 Aarts et al. ..... 381/61
2007/0124140 A1 * 5/2007 Iser et al. ..... 704/223

FOREIGN PATENT DOCUMENTS

EP 0994464 4/2000
EP 0994464 A1 4/2000
EP 1130577 A2 9/2001
EP 1130577 A3 9/2002

OTHER PUBLICATIONS

Bernd Iser and Gerhard Schmidt; Neural Networks Versus Codebooks in an Application for Bandwidth Extension of Speech Signals; 2003; pp. 565-568.

* cited by examiner

*Primary Examiner*—Susan McFadden
(74) *Attorney, Agent, or Firm*—Sunstein Kann Murphy & Timbers LLP

(57) ABSTRACT

A system is provided for extending the spectral bandwidth of a bandwidth limited audio signal by applying a nonlinear function to the bandwidth limited speech signal to generate the low frequency audio signal components that were attenuated in the bandwidth limited audio signal.

14 Claims, 8 Drawing Sheets

SYSTEM AND METHOD FOR EXTENDING SPECTRAL BANDWIDTH OF AN AUDIO SIGNAL

RELATED APPLICATIONS

This application claims priority of European Patent Application Serial Number 06 001 984, filed on Jan. 31, 2006, titled METHOD FOR EXTENDING THE SPECTRAL BANDWIDTH OF A SPEECH SIGNAL AND SYSTEM THEREOF; which is incorporated by reference in this application in its entirety.

BACKGROUND OF THE INVENTION

1. Field of the Invention

This invention relates to a system and method for extending the spectral bandwidth of an audio signal, and in particular, a speech signal. The invention further relates to using a non-linear function to generate attenuated lower frequency components of a bandwidth limited audio signal.

2. Related Art

Speech is the most natural and convenient way of human communication. This is one reason for the great success of the telephone system since its invention in the 19th century. Today, subscribers are not always satisfied with the quality of the service provided by the telephone system especially when compared to other audio sources, such as radio, compact disk or DVD. The degradation of speech quality using analog telephone systems is cautilized by the introduction of band limiting filters within amplifiers utilized to keep a certain signal level in long local loops. These filters have a pass band from approximately 300 Hz up to 3400 Hz and are applied to reduce crosstalk between different channels. However, the application of such band pass filters considerably attenuates different frequency parts of the human speech ranging from about 50 Hz up to 6000 Hz. The missing frequency components in the range between about 3400 Hz to 6000 Hz influence the perceivability of the speech, whereas the missing lower frequency components from 50 Hz to 300 Hz result in a lower speech quality.

Every speech signal is composed of different frequency components. Each speech signal has a fundamental frequency and the harmonics being an integer multiple of the fundamental frequency. In telecommunication systems, the fundamental frequency and the first harmonics may be attenuated and filtered out by the transmission system of the telecommunication system. Accordingly, speech systems, most of the time, include only the harmonics, but not the fundamental frequency that were filtered out by the band pass filter.

Great efforts have been made to increase the quality of telephone speech signals in recent years. One possibility to increase the quality of a telephone speech signal is to increase the bandwidth after transmission by means of bandwidth extension. The basic idea of these enhancements is to establish the speech signal components above 3400 Hz and below 300 Hz and to complement the signal with this estimate. In this case, telephone networks can remain untouched. In the prior art, bandwidth extension methods are known in which the spectral envelope of the speech signal is determined and an excitation signal is generated by removing the envelope. In these methods, codebook pairs and neuronal networks can be utilized. However, these methods require large memory and processing capacities.

The prior art methods further have the drawback that when determining and removing the envelope, signal components have to be averaged over time, so that the signal processing leads to a delay from signal input to signal output. Especially in telecommunication networks, the delay of the signal is limited to a certain value in order not to deteriorate the speech quality for the subscriber at the other end of the line. In addition, such signal processing is complex.

Accordingly, a need exists to provide a way of improving the speech quality in telecommunication systems, which is easy to implement, where signal delay is minimized and where processing requirements are reduced.

SUMMARY

A system is provided for extending the spectral bandwidth of a bandwidth limited audio signal, where the bandwidth limited audio signal may included at least harmonics of a fundamental frequency. According to one example method, a non-linear function may be applied to the bandwidth limited audio signal for generating the attenuated lower frequency components of the bandwidth limited audio signal. The generated low frequency components may then be added to the bandwidth limited audio signal resulting in an improved audio signal, i.e., bandwidth extended audio signal or extended audio signal. By adding generated low frequency components to the bandwidth limited audio signal, it may not be necessary to calculate the spectral envelope of the speech signal, which can result in lower processing requirements for calculating an extended bandwidth signal and can operate without delay.

The method may further include a step of determining a lower end of the bandwidth of the frequency spectrum of the bandwidth limited audio signal, and if a predetermined frequency spectrum is not contained in the bandwidth limited audio signal, generating the lower frequency components not contained in the bandwidth limited audio signal and adding the lower frequency components to the bandwidth limited audio signal. The method may further include adapting a lowpass filter in accordance with the lower end of the bandwidth of the frequency spectrum of the bandwidth limited audio signal.

The method may further include the step of determining the mean fundamental frequency of the bandwidth limited audio signal, and adapting a high-pass filter in accordance with the mean fundamental frequency.

The invention further relates to a system for extending the spectral bandwidth of an audio signal. In one example of an implementation, the system may include a determination unit for determining the maximum signal intensity of a bandwidth limited audio signal, and a processing unit in which a non-linear function is applied to the bandwidth limited audio signal for generating the lower frequency components of the audio signal not contained in the bandwidth limited speech signal. Additionally, a high-pass filter may be provided for high-pass filtering of the audio signal. Further, a low-pass filter may also be provided for low-pass filtering the audio signal. An adder may also be provided in the system for adding the original bandwidth limited audio signal to the high- or low-pass filtered signal, so that a bandwidth extended audio signal may be obtained.

In another implementation, a bandwidth determination unit may further be provided for determining the bandwidth of the audio signal, and for determining whether to add frequency components. Additionally, a fundamental frequency determination unit may be provided for determining the mean fundamental frequency of the audio signal.

Other devices, apparatus, systems methods features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The components in the figures are not necessarily to scale, emphasis instead being placed upon illustrating the principles of the invention. In the figures, like reference numerals designate corresponding parts throughout the different views.

DETAILED DESCRIPTION

FIGS. 1-8 illustrate various implementations of a system for extending the spectral bandwidth of a speech signal, including methods utilized to extend the spectral bandwidth of such signal. While the various implementations described in the specification relate, in particular, to extending the spectral bandwidth of a "speech" signal, those of skill in the art will recognize that the invention may be applied to other audio signals, as well.

Figure 1:
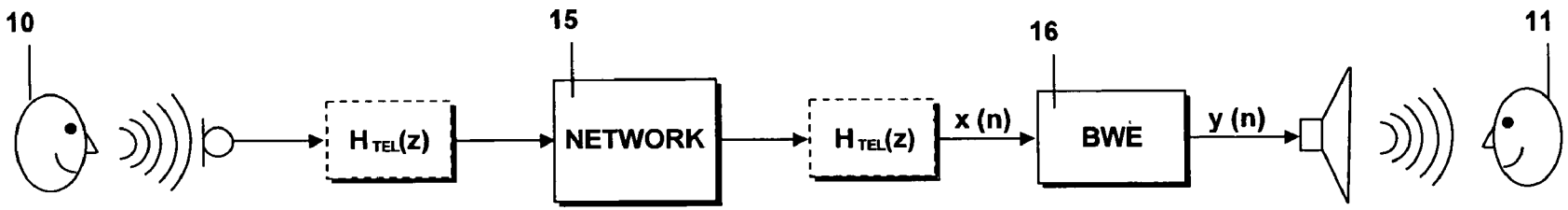
FIG. 1 shows an example of a telecommunication system including a bandwidth extension unit.

FIG. 1 shows an example of a telecommunication system including a bandwidth extension unit. A first subscriber 10 of the telecommunication system communicates with a second subscriber 11 of the telecommunication system. The speech signal from the first subscriber is transmitted via a telecommunication network 15. The telecommunication network 15 may include locations where the transmitted speech signal undergoes the bandwidth limitations that take place depending on the routing of the signal, such as illustrated by the dashed lines identifying $H_{TEL}(Z)$. The degradation of speech quality utilizing analog telephone systems may be cautilized by band limiting filters within amplifiers, these filters normally having a bandwidth from around 300 Hz to about 3400 Hz. One possibility to increase the speech quality for the subscriber 11 receiving the speech signal is to increase the bandwidth after the transmission by means of a bandwidth extension unit 16. The signal output from the telecommunication network 15 is a bandwidth limited speech signal, x(n). In the bandwidth extension unit 16, the bandwidth of the speech signal is extended before the extended audio signal (in this case, an extended speech signal) y(n) is then transmitted to the subscriber 11. In the present example, the lower spectral components of the speech signal from around 50 Hz to 300 Hz are generated. In extended audio signals, the sound is more natural and, as a variety of listenings indicates, the speech quality in general is increased.

Figure 2:
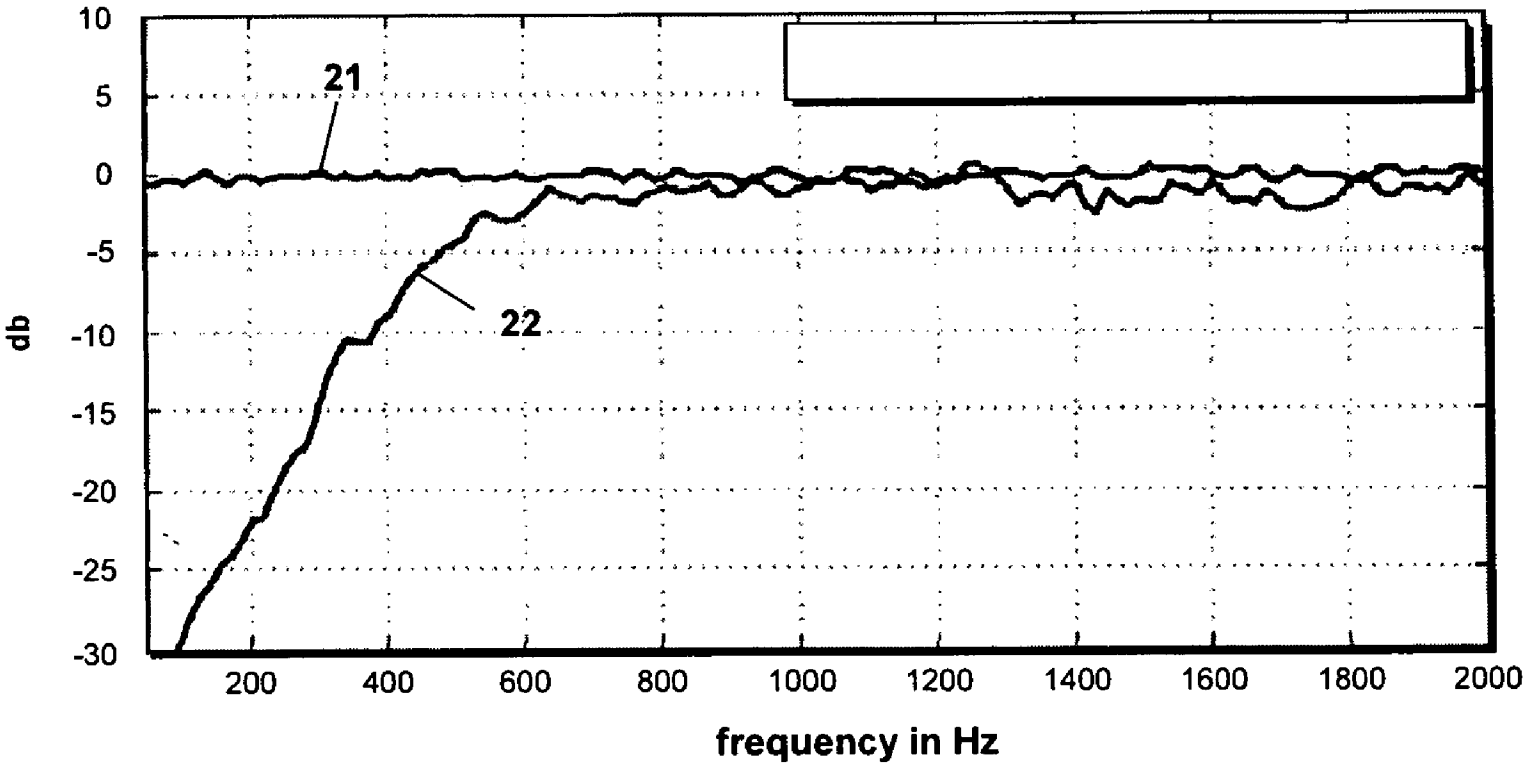
FIG. 2 shows an example of a spectra of a signal before and after transmission over the telecommunication network of FIG. 1.

FIG. 2 shows an example of the spectra of a signal before and after transmission over the telecommunication network 15 of FIG. 1. In the present case, for example, a cellular phone may be utilized to receive the signal characterized by the spectra in FIG. 2. In FIG. 2, graph 21, shows the spectrum of the signal as it is emitted from the subscriber 10. Additionally, the spectrum 22 is shown as measured before the signal enters the bandwidth extension unit 16. As can be seen from the output signal 22 of the communication system the lower frequency components are highly attenuated. At 300 Hz the attenuation is already 10 dB.

Figure 3:
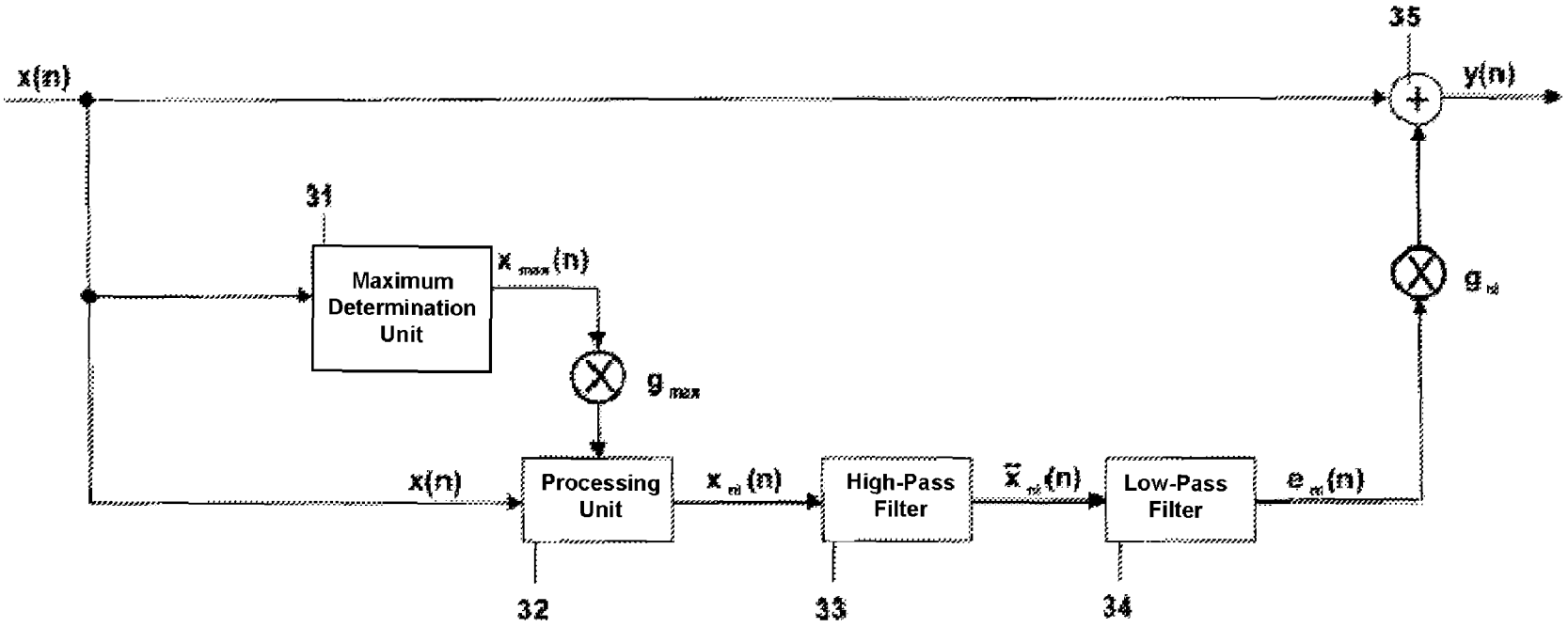
FIG. 3 shows an example of an implementation of a bandwidth extension unit for use in the system of FIG. 1.

FIG. 3 shows an example of an implementation of a bandwidth extension unit for use in the system of FIG. 1. For example, the bandwidth extension unit of FIG. 3 may be utilized to extend the bandwidth of the bandwidth limited signal in the lower frequency range illustrated by the spectra 22 of FIG. 2. In the implementation of FIG. 3, the bandwidth limited speech signal x(n) receives via the telecommunication network 15 input to a maximum determination unit 31, where the short time maximum of the absolute value of the bandwidth limited speech signal, depending on time n, ($x_{max}(n)$) is estimated. This maximum of the bandwidth limited speech signal can be determined for each value of a sample digital speech signal, where the maximum at time n−1 may be utilized to adjust the maximum at time n. This short time maximum $x_{max}$ may be estimated by the maximum determination unit 31 by using a multiplicative correction of a former estimated maximum value. For example, $x_{max}(n)$ may be determined by the following equation:

$$x_{\max}(n) = \begin{cases} \max\{K_{\max}|x(n)|, \quad \Delta_{ink}\, x_{\max}(n-1)\} & \text{if } |x(n)| > x_{\max}(n-1), \\ \Delta_{dek}\, x_{\max}(n-1), & \text{else} \end{cases} \quad (1)$$

For this estimation, two decrement and increment constants $\Delta_{dek}$ and $\Delta_{ink}$ are utilized. In this recursive formula the two constants $\Delta_{dek}$ and $\Delta_{ink}$ may meet the following condition:

$$0<\Delta_{dek}<1<\Delta_{ink}. \quad (2)$$

Additionally, the constant $K_{max}$ is utilized, which may be chosen from the following interval:

$$0.25<K_{max}<4. \quad (3)$$

The constant $K_{max}$ is utilized for limiting the estimated short time maximum $x_{max}(n)$ by the lower threshold $K_{max}$. With this formula it may be determined how close the maximum value is to the actual maximum value of the speech signal. If $K_{max}$ is at the lower threshold 0.25, this means that the minimum estimated maximum value is at least a quarter of the actual value. If $K_{max}$ is at the highest threshold 4, the estimated maximum value can become four times larger than the real maximum value. The constant $\Delta_{ink}$ may be chosen from the interval of $1.001<\Delta_{ink}<2$, and the constant $\Delta_{dek}$ may be chosen from the interval $0.5<\Delta_{dek}<0.999$. Tests have shown that the following values of $K_{max}$ and $\Delta_{dek}$ and $\Delta_{ink}$ may be utilized:

$$K_{max}=0.8,$$

$$\Delta_{ink}=1.05,$$

$$\Delta_{dek}=0.995.$$

The bandwidth limited speech signal x(n) is also fed to a processing unit 32 in which a non-linear function is applied to the bandwidth limited speech signal x(n). A bandwidth extension can be obtained when a speech signal containing harmonics of a fundamental frequency is multiplied with a non-linear function. According to the above-described implementation of the invention, the following non-linear quadratic function may be utilized:

$$x_{nl}(n)=c_2(n)x^2(n)+c_1(n)x(n)+c_0(n). \quad (4)$$

The coefficients $c_0$, $c_1$ and $c_2$ depend on time n, and as described further below, may be determined using $x_{max}(n)$. The present non-linear function, i.e., the present quadratic function of equation (4), may be utilized to generate signal components that are not contained in the bandwidth limited speech signal. For speech signals which are an integer multiple of a fundamental frequency, larger harmonics and the fundamental frequency components may be generated.

In human speech signals, the fundamental frequency depends on the person emitting the speech signal. A male voice signal can have a fundamental frequency between 50 Hz to 100 Hz, whereas the fundamental frequency of a female voice or a voice of a child can have a fundamental frequency of about 150 Hz and 200 Hz. As can be seen in FIG. 2, these lower frequency values are generally highly attenuated or even suppressed in a bandwidth limited speech signal. Also, the first and eventually the second harmonic may still be highly attenuated.

When a quadratic function is applied on or to a signal, the signal dynamic generally changes. To limit this dynamic change, time-variable coefficients are utilized. This means that the coefficients are adapted to the current input signal that is present at the input of the processing unit. According to one implementation, the short time maximum $x_{max}(n)$ calculated above in equation (1) may be utilized to calculate the coefficients $c_0$, $c_1$ and $c_2$ as follows:

$$c_0(n) = -x_{mit}(n-1), \quad (5)$$

$$c_1(n) = K_{nl,1} - c_2(n)x_{\max}(n), \quad (6)$$

$$c_2(n) = \frac{K_{nl,2}}{g_{\max}x_{\max}(n)+\varepsilon}. \quad (7)$$

In the above equations, $K_{nl,1}$, $K_{nl,2}$, $g_{max}$, $\epsilon$ are predetermined constants, and $x_{mit}(n)$ is the short time mean value of the output of the nonlinear function. This value is calculated using a first order recursion with the following equation:

$$x_{mit}(n)=\beta_{mit}x_{mit}(n-1)+(1-\beta_{mit})x_{nl}(n). \quad (8)$$

The time constant $\beta_{mit}$ may be chosen from the range $0.95<\beta_{mit}<0.9995$. The determination of $x_{max}$ may help to limit the change in dynamic when a quadratic function is utilized that is applied to the bandwidth limited speech signal. In the quadratic function of equation (4), the coefficient $c_2$ has a maximum value $x_{max}$ in the denominator in to limit the dynamic of the signal. The other constants utilized for calculating the coefficients can be selected, for example, from the following ranges:

$$0.5 \leqq k_{nl,1} \leqq 1.5,$$

$$0.1 \leqq k_{nl,2} \leqq 2,$$

$$1 \leqq g_{max} \leqq 3,$$

$$10^{-4}<\epsilon<10^{-6}.$$

For example, the following values can be utilized:

$$K_{nl,1}=1.2,$$

$$K_{nl,2}=1,$$

$$g_{max}=2,$$

$$\epsilon=10^{-5}.$$

Referring again to FIG. 3, the resulting extended speech signal output of the processing unit 32 is the signal $x_{nl}(n)$. This extended speech signal $x_{nl}(n)$ has low frequency components in the range up to 300 Hz, but also includes signal components of the bandwidth limited speech signal x(n) in the range between 300 Hz to 3400 Hz. In one implementation, these unwanted signal components may be removed. As explained above, the signal components below the fundamental speech frequency, e.g., below 100 Hz, are generally not part of a voice signal. By way of example, if the first subscriber 10 (FIG. 1) is using a mobile phone in a vehicle, the surround sound of the vehicle may have low frequency signal components below the fundamental speech frequency. In one implementation, these low frequency signal components can be removed using a high-pass filter 33 as shown in FIG. 3. Such high-pass filter 33 may be a first order Butterworth filter. The output signal of this Butterworth filter $\tilde{x}_{nl}(n)$ is calculated by the following equation:

$$\tilde{x}_{nl}(n)=a_{hp}(x_{nl}(n-1)-x_{nl}(n))+b_{hp}\tilde{x}_{nl}(n-1). \quad (9)$$

For the filter coefficients $a_{hp}$ and $b_{hp}$, the following values have proven appropriate values: $a_{hp}=0.99$ and $b_{hp}=0.95$. It should be understood that these filter coefficients may be chosen from a range nearby the above-described values.

After having removed the low signal components in the high-pass filter 33, the signal components included in the original bandwidth limited speech signal x(n) are still present in signal $\tilde{x}_{nl}(n)$. These signal components transmitted by the telecommunication system and all higher signal components can be filtered out by utilizing a low-pass filter 34. The remaining output signal $e_{nl}(n)$, having low frequency components that were attenuated in the original bandwidth limited speech signal x(n), can be written by the following equation:

$$e_{nl}(n) = \sum_{i=0}^{N_{tp,ma}} a_{tp,i}\tilde{x}_{nl}(n-i) + \sum_{i=1}^{N_{tp,ar}} b_{tp,i}e_{nl}(n-i). \quad (10)$$

In this context, Tschebyscheff low-pass filters of the order $N_{tp,ma}=N_{tp,ar}=4$ to 7 have proven suitable. Those skilled in the art will recognize that other types of low-pass filters may also be utilized. After filtering out desired signal components in the low-pass filter 34, the output signal $e_{nl}(n)$ then include the low frequency components of the speech signal that were filtered out in the telecommunication system, e.g., the signal components between 50 Hz or 100 Hz to about 300 Hz). These low signal components are added to the bandwidth limited speech signal x(n) in an adder 35 resulting in the bandwidth extended speech signal y(n). Additionally, a weighing factor $g_{nl}$ can be utilized to either attenuate or amplify the low signal components, as can be seen by the following equation:

$$y(n)=x(n)+g_{nl}e_{nl}(n). \quad (11)$$

The factor $g_{nl}$ can be chosen as being 1, so that no amplification or attenuation of the lower frequency components relative to the bandwidth limited speech signal is obtained. Depending on the implementation, the factor $g_{nl}$ may lie in a range between 0.001 to 4.

Figure 4:
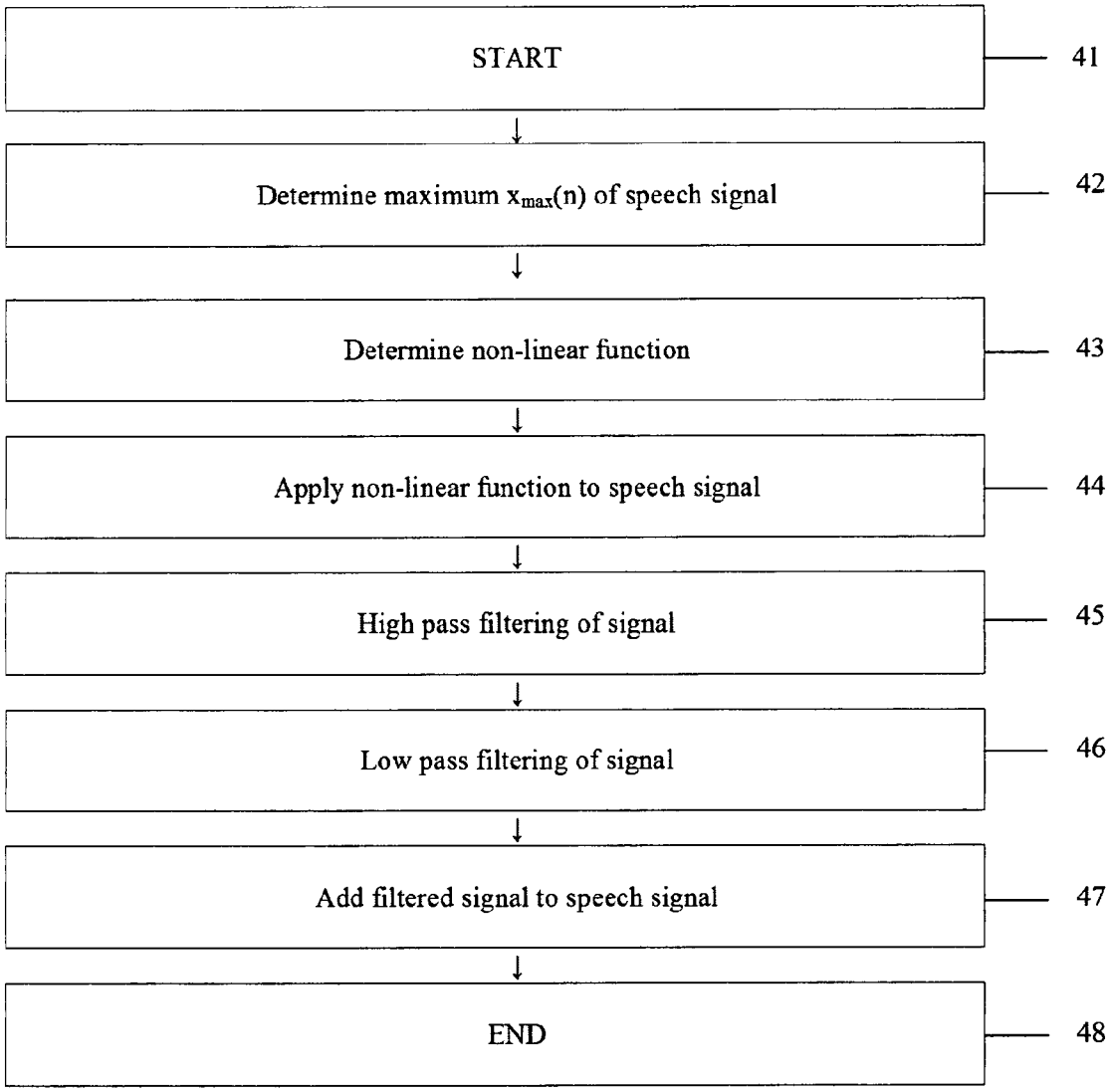
FIG. 4 is a flowchart showing one example of a method for extending the spectral bandwidth of a speech signal according to the invention.

FIG. 4 is a flowchart showing a method for extending the spectral bandwidth of a speech signal according to the invention. After the start of the method at step 41, the short time maximum of the absolute value of the bandwidth limited speech signal $x_{max}(n)$ is determined in, for example, the maximum determination unit 31 (step 42). Next, the non-linear function of equation (4) may be determined in step 43. The non-linear function may then be applied to the bandwidth limited speech signal in the processing unit 32 (step 44). The resulting extended speech signal $x_{nl}(n)$ may then be high-pass filtered by, for example, high-pass filter 33, to remove noise components below the fundamental speech frequency (step 45). In the next step 46, the signal $\tilde{x}_{nl}(n)$ may be low-pass filtered to remove the signal components already included in the bandwidth limited speech signal itself. Next, the filter signal $e_{nl}(n)$ is added to the original bandwidth limited speech signal in step 47, resulting in an improved speech signal y(n). The bandwidth extension method ends in step 50. When the quadratic function is multiplied with the speech signal, a constant component is generated (see, e.g., see equation (4)). According to an alternative implementation, the method may further include the step 48 of removing the constant component after applying the non-linear function to the bandwidth limited speech signal. The coefficient $c_0(n)$ may be utilized for removing this constant component resulting from the multiplication. As explained above, in the equation for determining $c_0$, (equation (5)) the value $x_{mit}(n)$ is utilized. This value is calculated using a first order recursion equation (8), as illustrated above.

Figure 5:
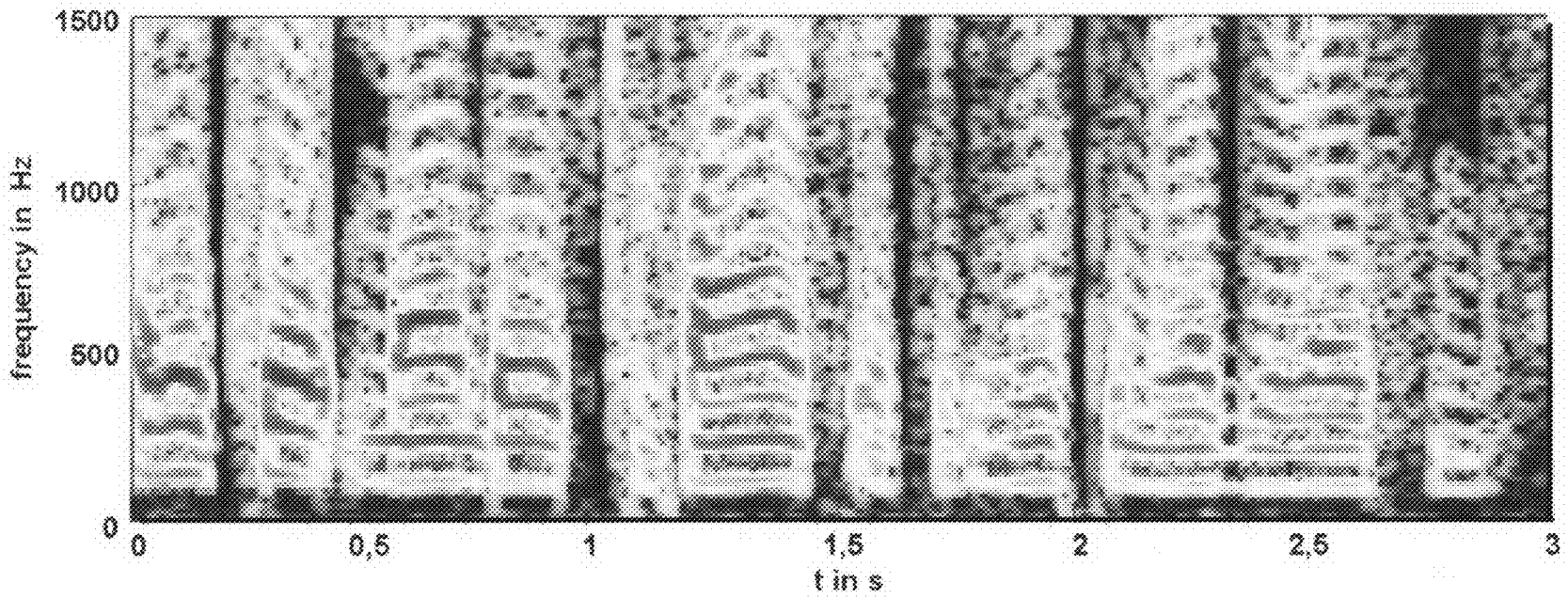
FIG. 5 shows an example of a frequency analysis of a speech signal before transmission.
Figure 6:
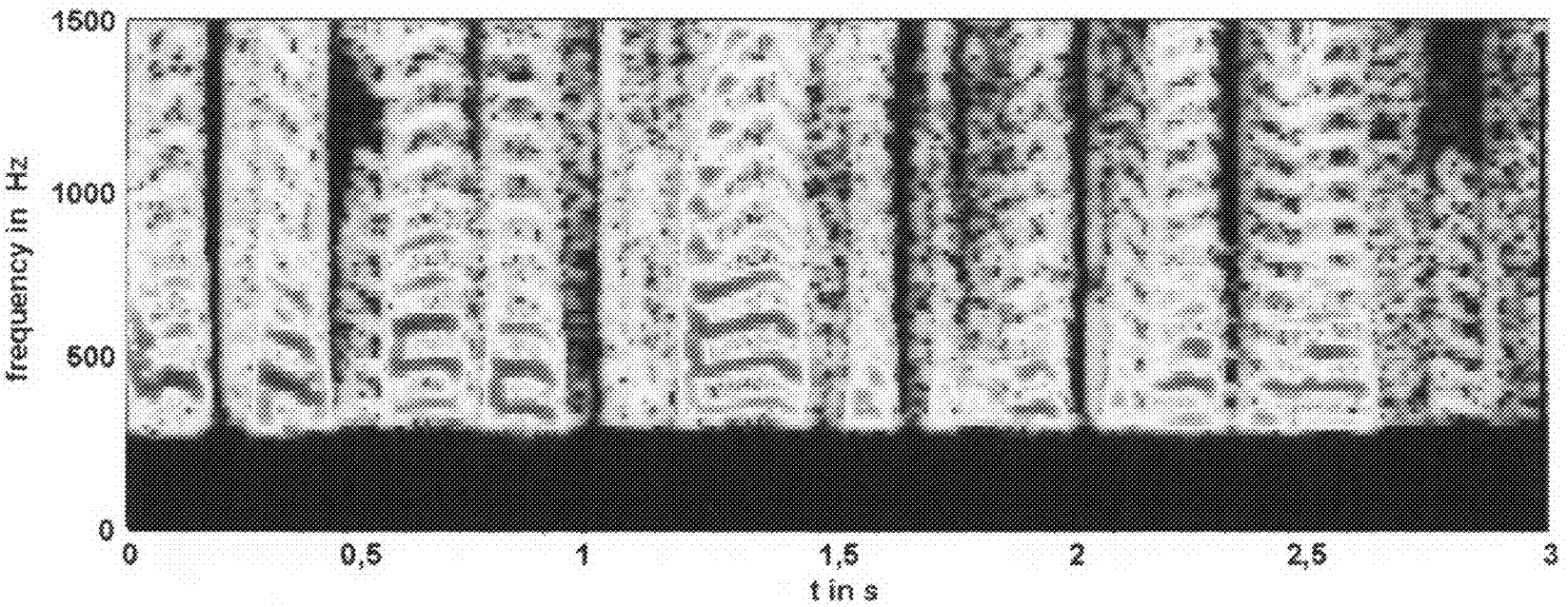
FIG. 6 shows an example of a frequency analysis of a speech signal after transmission.
Figure 7:
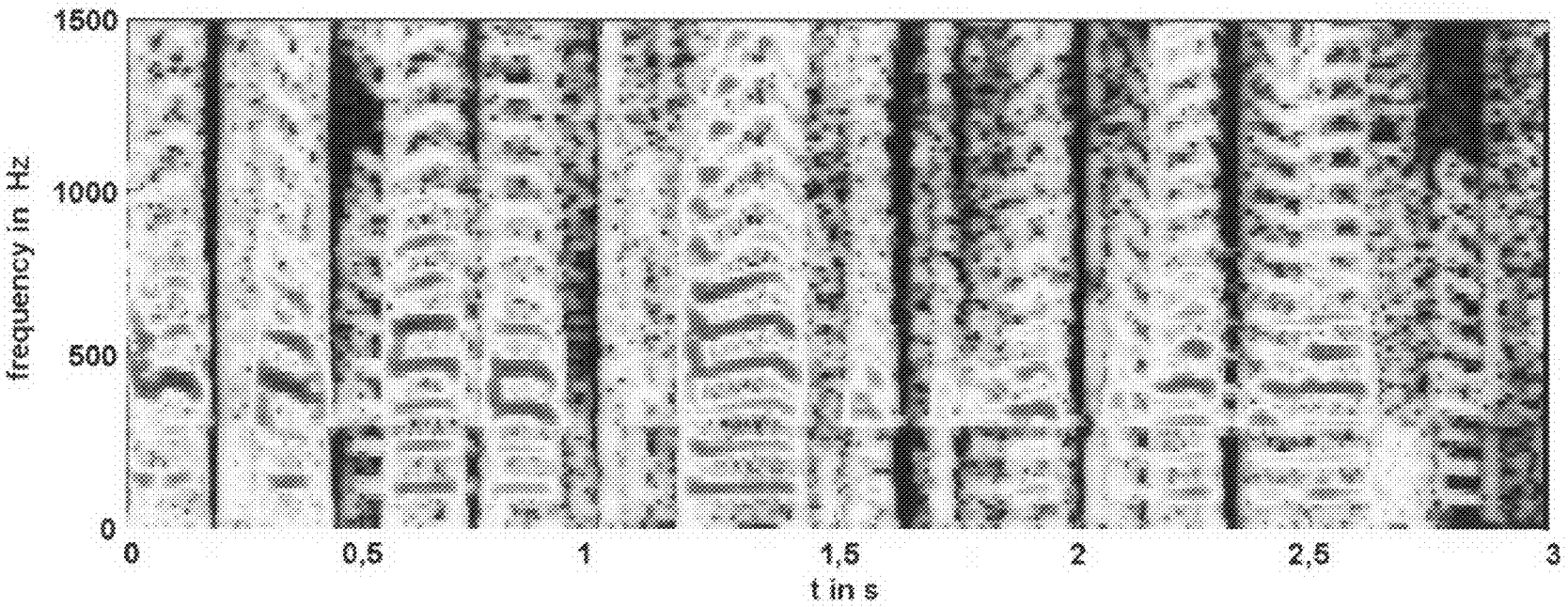
FIG. 7 shows an example of a frequency analysis of an extended bandwidth speech signal obtained utilizing system of FIG. 1.

FIG. 5 shows a frequency analysis of a speech signal before transmission, FIG. 6 shows a frequency analysis of a speech signal after the signal is bandwidth limited upon transmission, and FIG. 7 shows a frequency analysis of an extended bandwidth speech signal obtained utilizing a bandwidth extend audio signal system described above.

In FIG. 5, the signal components of a speech signal as emitted by the first subscriber 10 is shown. The signal was directly recorded near the mouth of the user. If this signal shown in FIG. 5 is transmitted via a telecommunication network to another cellular telephone, a received decoded bandwidth limited signal generally has the frequency components shown in FIG. 6. As illustrated in FIG. 6, the low signal components, e.g., below 300 Hz, are missing. After processing the signal shown in FIG. 6, as explained in connection with FIG. 3, an extended bandwidth signal can be obtained as shown in FIG. 7. As can be seen from FIG. 7, the lower signal components may be reconstructed and added back into the signal. Even if the signal quality of FIG. 7 does not identically match that of FIG. 5, the signal quality of the signal shown in FIG. 7 nonetheless has improved over the signal quality of the signal shown in FIG. 6.

Figure 8:
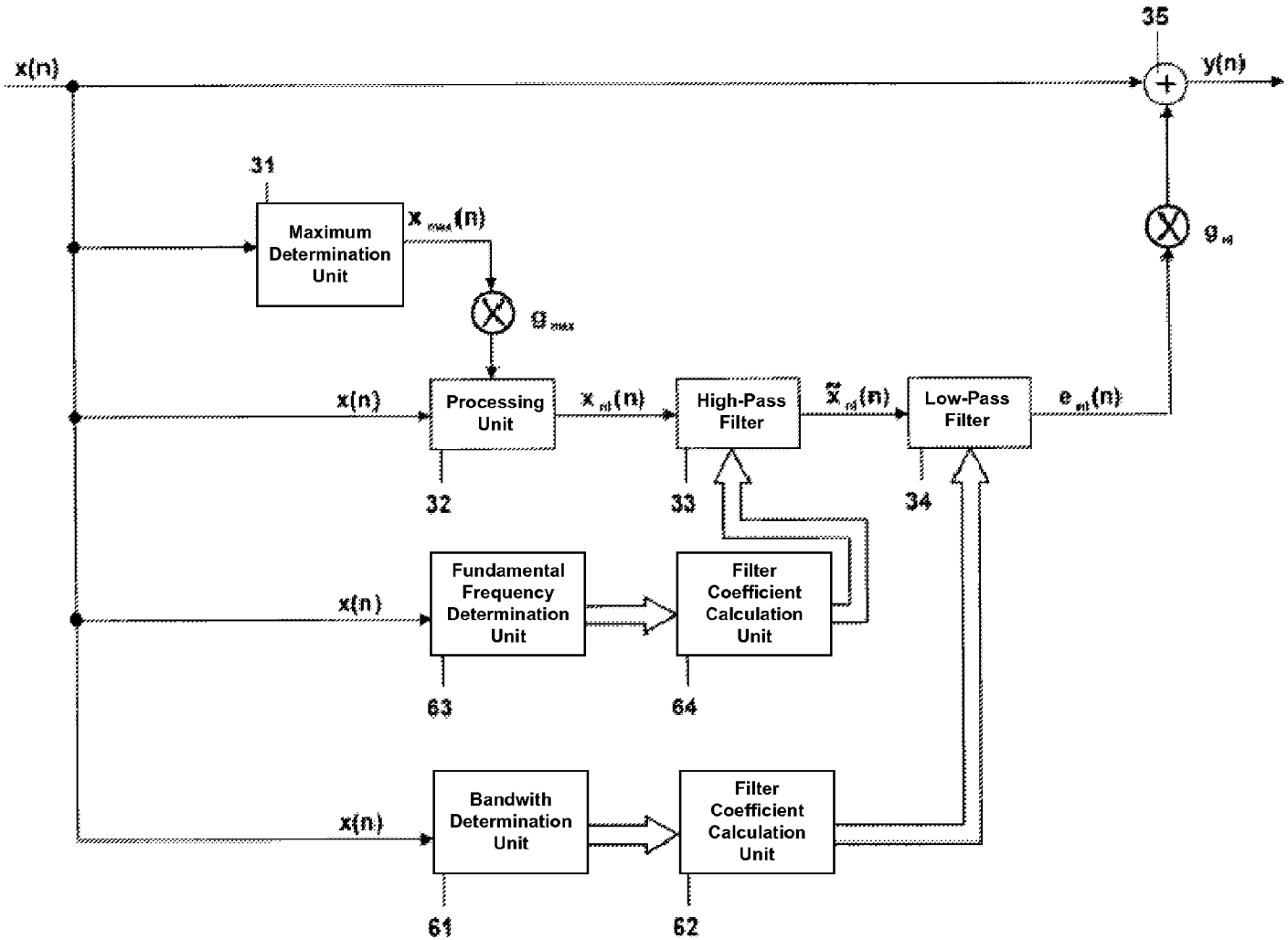
FIG. 8 shows another implementation of a system for extending the bandwidth of a bandwidth limited speech signal.

In FIG. 8, another implementation of a system for extending the bandwidth of a bandwidth limited speech signal is shown. For the system of FIG. 8, the components having the same reference numerals as those components shown in FIG. 3 are the same as described with respect to FIG. 3. Accordingly, a detailed description of these components is omitted.

The attenuation of a speech signal can depend on the microphone utilized to record the signal, the way the signal is coded, the signal processing in the telephone of the first subscriber, or the telecommunication network, respectively. As a result, in some circumstances, large attenuation of a speech signal over a broad range of frequencies can occur. In other cases, the attenuation of the signal may be less significant, or the signal may not be attenuated in the low frequency range at all. In one implementation, if the low frequencies are attenuated, these low frequencies may be generated, via, for example, a bandwidth extension unit 16, and then added to the signal. If, however, the low frequencies remain present in the speech signal, no signal components are added to the signal. To accommodate different attenuation situations, it may be desirable to detect the frequencies present in the speech signal. In one implementation, this may be done utilizing a bandwidth determination unit 61 in which frequency components of signals are analyzed, so that it can be determined which frequency components have been transmitted and which frequency components have been attenuated. Depending on the estimated frequency components of the speech signal x(n), the low-pass filter 34 may be controlled in accordance with the determined spectrum. To this end, a calculation unit 62 may be provided in which low-pass filter coefficients $a_{tp,i}$ and $b_{tp,i}$ are calculated (see equation (10)), and adapted to the bandwidth of the speech signal in such a way that frequency components that are already included in the signal x(n) itself are filtered out in the low-pass filter 34. The adapted filter coefficients $a_{tp,i}$ and $b_{tp,i}$ are then supplied to the low-pass filter 34. If the signal included all signal components, the system is controlled in such a way that no low-pass filtering is carried out.

Also as shown in FIG. 8, another implementation of the system shown in FIG. 3 is described. As previously mentioned, the signal components below the fundamental frequency generally do not include speech components and are therefore suppressed by the high-pass filter 33. However, the fundamental frequency is not a constant value and may depend on the fact whether, for example, a male or female or a child voice is transmitted via the telecommunication system. In general, depending on the source of the speech signal, the fundamental frequency can change between about 50 Hz and about 200 Hz. Accordingly, the high-pass filter 33 can be adapted to the fundamental frequency. This can be achieved by a fundamental frequency determination unit 63, in which the mean fundamental frequency of the speech signal is determined. If the determined fundamental frequency is very low (e.g. 50 Hz), the high-pass filtering may be omitted, or the high-pass filter may be adapted in such a way that only signals below 50 Hz are filtered out. In the case of the fundamental frequency being around 200 Hz, the high-pass filter 33 may be adapted accordingly to filter out, for example, the frequencies below the determined fundamental frequency. When the mean fundamental frequency is determined in unit 63, the filter coefficients $a_{hp}$ and $b_{hp}$ (see equation (9)) for the high-pass filter 33 can be adapted accordingly in a filter coefficient calculation unit 64, which are then fed to the high-pass filter 33.

It should be understood that the bandwidth determination unit 61 and the corresponding filter coefficient calculation unit 62 can be utilized independently from the fundamental frequency determination unit 63. This means that either of the two units 61 and 63 or both units 61 and 63 may be utilized.

While various implementations of the invention have been described, it will be apparent to those of ordinary skill in the art that other embodiments and implementations are possible within the scope of this invention. For example, the described method and system can be utilized in connection with many different frequency characteristics of a recorded speech signal or other audio signal, and different hardware may be utilized for the recording of signals, or utilized for the signal transmission, such as ISDN, GSM or CDMA. In addition, the system can easily handle noise components from the environment of the speaking person, e.g. when the signal is to be transmitted from a vehicle environment. Moreover, the bandwidth limited audio signal may be a speech signal which was transmitted via a telecommunication network as described herein. Alternatively, it is also possible that the audio signal is transmitted via any other transmission system in which the bandwidth of the audio signal is limited due to the transmission of the signal. Accordingly, the invention is not to be restricted except in light of the attached claims and their equivalents.

What is claimed is:

1. A method in a telecommunication system for extending a spectral bandwidth of a bandwidth limited audio signal (x(n)) having at least one harmonic of a fundamental frequency, the method comprising:

applying using a processor a nonlinear function to the bandwidth limited audio signal to generate an extended audio signal $x_{n1}(n)$, the non-linear function being a quadratic equation:

$$x_{n1}(n)=c_2(n)x^2(n)+c_1(n)x(n)+c_0(n),$$

the coefficients $c_0$, $c_1$, $c_2$ depending on time n, wherein the application of the nonlinear function to the bandwidth limited speech signal results in a first extended speech signal, the coefficients being determined in such a way that $$c_0(n)=-x_{mit}(n-1),$$

$$c_1(n)=K_{n1,1}-c_2(n)x_{max}(n), \text{ and}$$

$$c_2(n)=(K_{n1,2})/(g_{max}x_{max}(n)+\epsilon),$$

wherein $K_{n1,1}$, $K_{n1,2}$, $g_{max}$ and $\epsilon$ are predetermined constants, $x_{max}(n)$ is the short time maximum of the absolute value of the bandwidth limited audio signal, and $x_{mit}(n)$ is the short time mean value of the quadratic function.

2. The method of claim 1 further comprising the step of removing a constant component after applying the nonlinear function to the bandwidth limited audio signal.

3. The method of claim 1 further comprising the step of high-pass filtering the extended audio signal.

4. The method of claim 1 further comprising the step of low-pass filtering the extended audio signal to obtain a low frequency audio signal.

5. The method of claim 4 further comprising the step of adding the low frequency audio signal to the bandwidth limited audio signal to obtain an improved bandwidth extended audio signal.

6. The method of claim 1 further comprising the steps of: determining a lower end of the spectral bandwidth of the bandwidth limited audio signal; and if a predetermined frequency spectrum is not contained in the bandwidth limited audio signal, generating a low frequency component and adding the low frequency component to the bandwidth limited audio signal to obtain an improved bandwidth extended audio signal.

7. The method of claim 6 further comprising providing a low-pass filter for filtering out frequency components comprised in the bandwidth limited audio signal, and adjusting the low-pass filter in accordance with the lower end of the spectral bandwidth of the bandwidth limited audio signal.

8. The method of claim 6 further comprising the determining a mean fundamental frequency of the bandwidth limited audio signal; providing a high-pass filter for filtering out frequency components below a pre-determined value; and adapting the high-pass filter based on the mean fundamental frequency.

9. The method of claim 1, where the bandwidth limited audio signal is a speech signal transmitted via a telecommunication network.

10. A system for extending the spectral bandwidth of a bandwidth limited audio signal having at least one harmonic of a fundamental frequency, the system comprising:

a determination unit for determining a maximum signal intensity of the bandwidth limited audio signal;

a processing unit for applying a nonlinear function to the bandwidth limited audio signal for generating the lower frequency components of the speech signal which are lower than a predetermined signal component, the nonlinear function being a quadratic equation:

$$x_{n1}(n)=c_2(n)x^2(n)+c_1(n)x(n)+c_0(n),$$

the coefficients $c_0$, $c_1$, $c_2$ depending on time n, wherein the application of the nonlinear function to the bandwidth limited speech signal results in a first extended speech signal, the coefficients being determined in such a way that $$c_0(n)=-x_{mit}(n-1),$$

$$c_1(n)=K_{n1,1}-c_2(n)x_{max}(n), \text{ and}$$

$$c_2(n)=(K_{n1,2})/(g_{max}x_{max}(n)+\epsilon),$$

wherein $K_{n1,1}$, $K_{n1,2}$, $g_{max}$ and $\epsilon$ are predetermined constants, $x_{max}(n)$ is the short time maximum of the absolute value of the bandwidth limited audio signal, and $x_{mit}(n)$ is the short time mean value of the quadratic function.

11. The system of claim 10 further comprising a high-pass filter for obtaining a high-pass filtered signal.

12. The system of claim 11 further comprising a low-pass filter for obtaining a low-pass filtered signal; and an adder for adding the low-pass filtered signal to the bandwidth limited audio signal.

13. The system of claim 10, further comprising a bandwidth determination unit for determining the bandwidth of the bandwidth limited audio signal.

14. The system of claim 10, further comprising a fundamental frequency determination unit for determining the mean fundamental frequency of the bandwidth limited audio signal.

* * * * *